US012416124B2

(12) United States Patent
Klein

(10) Patent No.: US 12,416,124 B2
(45) Date of Patent: Sep. 16, 2025

(54) DISSECTING BARRIER

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 791 days.

(21) Appl. No.: 17/434,468

(22) PCT Filed: Feb. 27, 2020

(86) PCT No.: PCT/IB2020/051701
§ 371 (c)(1),
(2) Date: Aug. 27, 2021

(87) PCT Pub. No.: WO2020/174445
PCT Pub. Date: Sep. 3, 2020

(65) Prior Publication Data

US 2022/0136188 A1 May 5, 2022

Related U.S. Application Data

(60) Provisional application No. 62/811,576, filed on Feb. 28, 2019.

(51) Int. Cl.
*E01F 13/12* (2006.01)
*E01F 13/08* (2006.01)

(52) U.S. Cl.
CPC ..... *E01F 13/123* (2013.01); *E01F 13/08* (2013.01)

(58) Field of Classification Search
CPC ..... E01F 13/08; E01F 13/123
USPC ..... 404/6
See application file for complete search history.

(56) References Cited

U.S. PATENT DOCUMENTS

| | | | | |
|---|---|---|---|---|
| 2,737,740 | A | 3/1956 | Genoe | |
| 2,783,055 | A | 2/1957 | Michaud | |
| 2,961,786 | A | 11/1960 | Lowmaster | |
| 3,982,734 | A | 9/1976 | Walker | |
| 4,158,514 | A * | 6/1979 | Dickinson | E01F 13/123 404/6 |
| 4,279,105 | A | 7/1981 | Cameron | |
| 4,354,771 | A | 10/1982 | Dickinson | |
| 4,367,975 | A | 1/1983 | Tyers | |
| 4,426,801 | A | 1/1984 | Gates | |
| 4,624,600 | A | 11/1986 | Wagner et al. | |
| 4,705,426 | A | 11/1987 | Perea | |
| 4,762,439 | A | 8/1988 | Carlyle | |

(Continued)

FOREIGN PATENT DOCUMENTS

| | | |
|---|---|---|
| CN | 2853891 Y | 1/2007 |
| CN | 204626286 U | 9/2015 |

(Continued)

*Primary Examiner* — Raymond W Addie
(74) *Attorney, Agent, or Firm* — William H. Dippert; Laurence A. Greenberg; Werner H. Stemer

(57) ABSTRACT

The present subject matter provides a dissecting element that comprises a flat body having an upper side and a bottom side and opposite edges; a hinge on the bottom side wherein the hinge is connected to a surface, wherein the dissecting element is configured to move between an erected state in which the flat body is in an upright position and a horizontal state in which the flat body is adjacently lying on the surface. A plurality of dissecting elements can be provided on a portable ramp and several dissecting elements or ramps establish a barrier system. A method is also provided to prevent passage of vehicles using the dissecting elements.

21 Claims, 10 Drawing Sheets

(56) References Cited

U.S. PATENT DOCUMENTS

| | | | | |
|---|---|---|---|---|
| 4,773,629 | A | 9/1988 | Yodock | |
| 4,875,028 | A | 10/1989 | Chou | |
| 4,998,843 | A | 3/1991 | Mothe | |
| 5,188,342 | A | 2/1993 | Ouellette et al. | |
| 5,217,318 | A | 6/1993 | Peppel | |
| 5,535,555 | A | 7/1996 | Boyd et al. | |
| 5,588,774 | A | 12/1996 | Behan | |
| 5,798,102 | A * | 8/1998 | McMichael | A61P 9/00 424/94.1 |
| 5,882,140 | A | 3/1999 | Yodock, Jr. et al. | |
| 5,975,791 | A | 11/1999 | McCulloch | |
| 6,409,418 | B1 | 6/2002 | Blair et al. | |
| 6,672,799 | B2 | 1/2004 | Earl | |
| 6,702,512 | B1 | 3/2004 | Reale | |
| 6,905,281 | B2 | 6/2005 | Kang | |
| 7,025,526 | B2 | 4/2006 | Blair | |
| 7,172,176 | B1 | 2/2007 | Eastland | |
| 7,918,622 | B2 | 4/2011 | Whitford | |
| 7,950,173 | B2 | 5/2011 | Jedlicka | |
| 8,256,985 | B2 | 9/2012 | Ashmead | |
| 9,739,328 | B1 | 8/2017 | Degroot et al. | |
| 9,834,927 | B2 | 12/2017 | Huff | |
| 9,945,084 | B1 | 4/2018 | Warford | |
| 10,266,999 | B2 * | 4/2019 | Rothschild | E01F 13/02 |
| 10,724,191 | B2 | 7/2020 | Pan | |
| 2006/0076544 | A1 | 4/2006 | Kurple | |
| 2009/0028639 | A1 | 1/2009 | Thomas | |
| 2010/0178104 | A1 * | 7/2010 | Bare | E01F 13/12 404/6 |
| 2012/0017743 | A1 | 1/2012 | Pierret et al. | |
| 2012/0121336 | A1 | 5/2012 | Arciszewski | |
| 2012/0177439 | A1 | 7/2012 | More et al. | |
| 2017/0204575 | A1 | 7/2017 | Klein | |
| 2019/0161927 | A1 | 5/2019 | Pan | |

FOREIGN PATENT DOCUMENTS

| | | | |
|---|---|---|---|
| CN | 106049307 | A | 10/2016 |
| CN | 106468049 | A | 3/2017 |
| CN | 107227705 | A | 10/2017 |
| DE | 10108586 | A1 | 9/2002 |
| EP | 0253656 | A1 | 1/1988 |
| EP | 0465748 | A1 | 1/1992 |
| EP | 0823510 | A2 | 2/1998 |
| EP | 1293686 | A2 | 3/2003 |
| EP | 2107163 | A2 | 10/2009 |
| EP | 3323942 | A1 | 5/2018 |
| EP | 3447194 | A1 | 2/2019 |
| FR | 2854413 | A1 | 11/2004 |
| GB | 1478840 | | 7/1977 |
| GB | 2261006 | A | 5/1993 |
| GB | 2430964 | A | 4/2007 |
| GR | 20050100073 | A | 10/2006 |
| IL | 250702 | A | 4/2017 |
| IL | 284568 | A | 8/2021 |
| IL | 285873 | A | 10/2021 |
| IL | 287502 | A | 12/2021 |
| IL | 266217 | B1 | 3/2023 |
| JP | 2000178932 | A | 6/2000 |
| JP | 4461330 | B2 | 5/2010 |
| JP | 2013221274 | A | 10/2013 |
| WO | 2007105940 | A1 | 9/2007 |
| WO | 2016030886 | A1 | 3/2016 |
| WO | 2019016812 | A1 | 1/2019 |
| WO | 2019097526 | A1 | 5/2019 |

* cited by examiner

DISSECTING BARRIER

CROSS-REFERENCE TO RELATED PATENT APPLICATIONS

This patent application is a U.S. National Phase filing under 35 U.S.C. § 371 of co-pending PCT Patent Application No. PCT/IB2020/051701, filed Feb. 27, 2020, which is based upon and claims the priority of U.S. Provisional Patent Application Ser. No. 62/811,576, filed Feb. 28, 2019, each of is incorporated herein by reference in its entirety.

FIELD

The present subject matter relates to barriers. More particularly, the present subject matter relates to barriers configured to dissect vehicles.

BACKGROUND

There are occasions when there is a need to block passage of vehicles with a barrier, by any means, including dissecting the vehicle when attempting to pass across the barrier, in order to absolutely prevent passage of the barrier by the vehicle.

SUMMARY

Unless otherwise defined, all technical and scientific terms used herein have the same meaning as commonly understood by one of ordinary skill in the art to which this subject matter belongs. Although methods and materials similar or equivalent to those described herein can be used in the practice or testing of the present subject matter, suitable methods and materials are described below. In case of conflict, the patent specification, including definitions, will control. In addition, the materials, methods, and examples are illustrative only and not intended to be limiting.

According to one aspect of the present subject matter, there is provided a dissecting element comprising: a flat body having an upper side and a bottom side and opposite edges; a hinge on the bottom side wherein the hinge is connected to a surface, wherein the dissecting element is configured to move between an erected state in which the flat body is in an upright position and a horizontal state in which the flat body is adjacently lying on the surface.

According to another embodiment, at least one of the opposite edges is sharp.

According to another embodiment, the surface is a portable ramp.

According to another embodiment, the surface is a ground onto which vehicles pass.

According to another aspect of the present subject matter, there is provided a dissecting barrier unit comprising: at least one dissecting element having a flat body with opposite edges; a ramp onto which said at least one dissecting unit is pivotally connected; wherein the at least one dissecting element is configured to move between an erected state in which the flat body is in an upright position and a horizontal state in which the flat body is adjacently lying on the ramp.

According to another embodiment, the at least one dissecting element is pivotally connected to the ramp by a hinge.

According to another embodiment, the ramp is configured to be anchored to a surface.

According to another embodiment, the ramp comprises at least one anchoring element configured to facilitate anchoring the ramp to the surface.

According to another embodiment, the anchoring element is in a form of a hole, configured to accommodate a sticking element, that is configured to be stuck in the surface.

According to another embodiment, the ramp is permanently anchored to the surface.

According to another embodiment, the ramp is reversibly anchored to the surface.

According to another embodiment, the ramp is configured to be connected to at least one other ramp.

According to another embodiment, the ramp is configured to permanently be connected to the at least one other ramp.

According to another embodiment, the ramp is configured to reversibly be connected to the at least one other ramp.

According to another embodiment, the ramp further comprising at least one connecting element for connecting the ramp to the at least one other ramp.

The dissecting barrier unit of claim 15, wherein the connecting element is a tube-like element attached beneath the ramp and configured to accommodate a shaft-like element configured to be inserted into the tube-like element of one ramp and a tube-like element of an adjacent ramp, thus connecting the ramps and holding them together.

According to another embodiment, the ramp is configured to allow passage of a vehicle over the ramp when the dissecting elements are in a horizontal state.

According to another embodiment, the ramp is substantially flat.

According to another embodiment, the ramp is substantially curved.

According to another embodiment, a degree of curvature of the ramp is such that it allows free passage of a vehicle over the ramp when the dissecting elements are in a horizontal state.

According to another embodiment, the flat body has an upper side that is wide and lower side that is relatively narrow.

According to another embodiment, the dissecting element is configured to partially dissect an approaching vehicle through impact with the edges of the flat body.

According to another embodiment, at least part of the edges of the dissecting element is sharp, having a blade-like shape.

According to another embodiment, the dissecting element further comprises a stopper configured to stop movement of the dissecting element and firmly hold the dissecting element in the erected state.

A dissecting barrier system is also provided that comprises a plurality of dissecting elements in accordance with embodiments of the subject matter.

A dissecting barrier system is also provided that comprises a plurality of dissecting barrier units with embodiments of the subject matter.

According to another embodiment, at least two of the dissecting barrier units are connected one to the other.

According to another embodiment, each one of the dissecting elements is independently controlled.

According to another embodiment, each one of the dissecting barrier units is adapted to be in an erected state or in horizontal state.

According to another embodiment, each one of the dissecting barrier units is independently controlled.

According to another embodiment, the dissecting barrier units are remotely controlled.

According to another embodiment, the dissecting elements are remotely controlled.

A method of blocking vehicles is also provided in accordance with another embodiment comprises providing a dissecting element, and positioning the dissecting element with the opposite edges directed towards a direction from which the vehicles are approaching.

Another method of blocking vehicles is also provided in accordance with another embodiment comprises providing a dissecting barrier unit and positioning the at least one dissecting element with the opposite edges directed towards a direction from which the vehicles are approaching.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms may be embodied in practice.

In the drawings.

DESCRIPTION OF THE PREFERRED EMBODIMENTS

Figure 1:
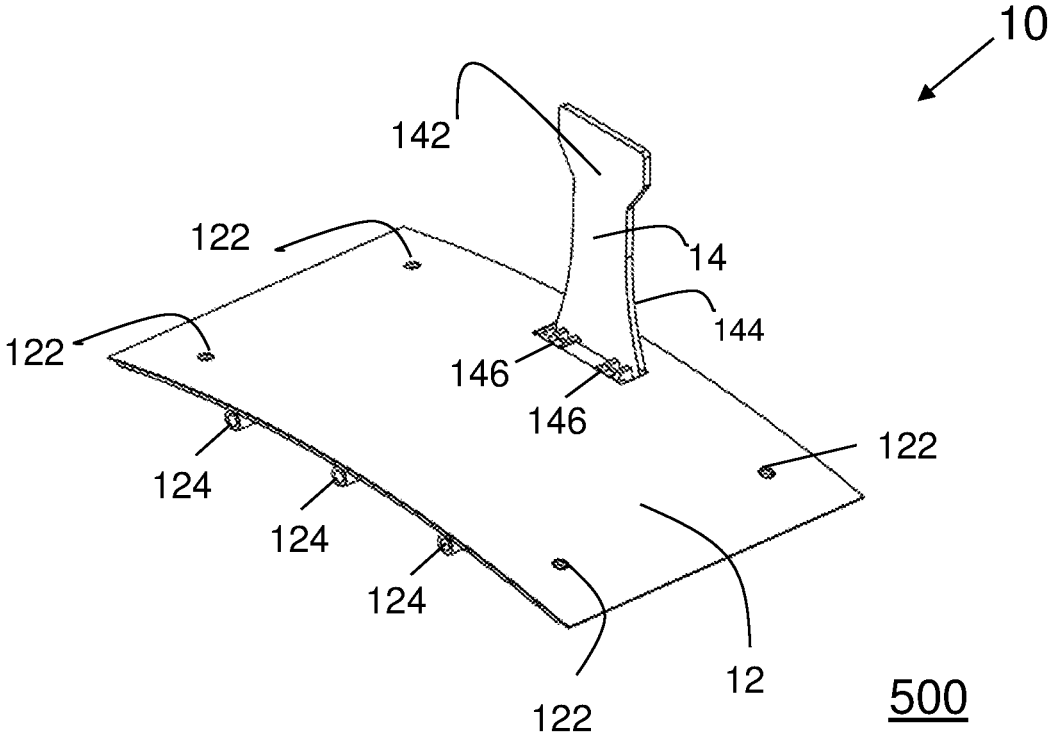
FIG. 1 schematically illustrates, according to an exemplary embodiment, a side perspective view of a dissecting barrier unit in a vehicle blocking state.
Figure 2:
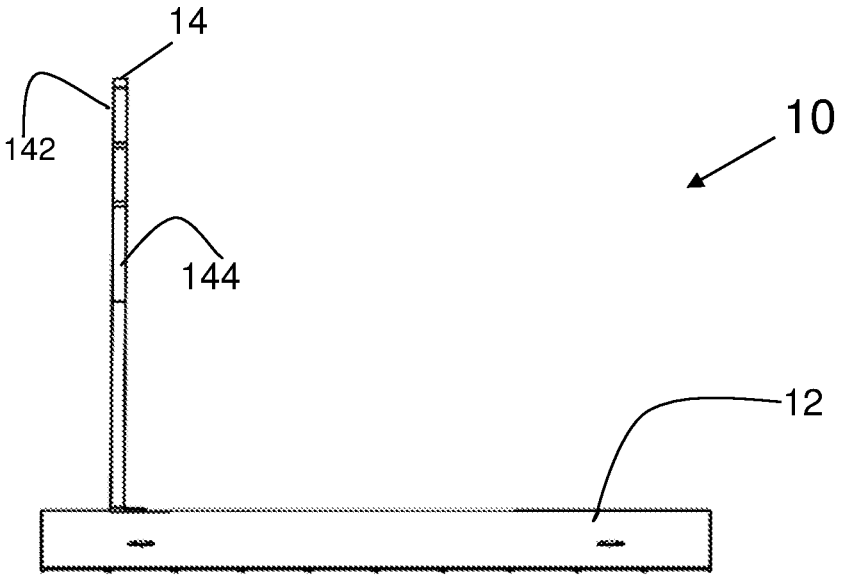
FIG. 2 schematically illustrates, according to an exemplary embodiment, a front view of a dissecting barrier unit in a vehicle blocking state.

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale.

For clarity, non-essential elements were omitted from some of the drawings.

The present subject matter is aimed at providing a dissecting element adapted to be used as barrier to approaching vehicles that are impacted by the elements that act as blades and dissect parts of the vehicle.

The present subject matter is also aimed at providing a dissecting barrier unit, configured to be either in a vehicle blocking state, or a vehicle passage state. The dissecting barrier unit is further configured to allow free passage of pedestrians, animals and small vehicles like bicycles and motorcycles, in either state—vehicle passage state or vehicle blocking state.

The present subject matter further provides a dissecting barrier system comprising a plurality of dissecting barrier units.

Reference is now made to FIGS. 1-4 schematically illustrating, according to an exemplary embodiment, a different views of a dissecting barrier unit in a vehicle blocking state. According to one embodiment, a dissecting barrier unit 10 comprises a ramp 12 and a dissecting element 14 connected to the ramp 12. According to another embodiment, the dissecting element 14 is pivotally connected to the ramp 12. According to yet another embodiment, the dissecting element 14 is pivotally connected to the ramp 12 with a hinge 146, illustrated for example in FIGS. 1 and 3. The ramp can be portable.

The dissecting element comprises a flat body having an upper side and a bottom side and opposite edges as well as a hinge on the bottom side wherein the hinge is connected to a surface. The dissecting element is configured to move between an erected state in which the flat body is in an upright position and a lying state in which the flat body is adjacently lying on the surface.

According to one embodiment, the surface is a ramp 12 that is configured to be placed on a surface 500 (ground) in a place where there is a desire to block passage of vehicles. The ramp 12 is configured to be placed on any type of surface 500 known in the art, for example a paved road, a non-paved road, ground, sand, rock and the like. According to another embodiment, the ramp 12 is configured to be anchored to the surface 500. Any mechanism known in the art for anchoring the ramp 12 to the surface 500 is under the scope of the present subject matter, for example screwing, nailing, pegging and the like. According to yet another embodiment, the ramp 12 comprises at least one anchoring element 122 configured to facilitate anchoring of the ramp 12 to the surface 500. Any type of anchoring element 122 is under the scope of the present subject matter. An exemplary embodiment of an anchoring element 122 is, for example, an anchoring element 122 in a form of a hole in the ramp 12, configured to accommodate a attaching element, for example a nail, a screw, a peg and the like, that is configured to be stuck in the surface through the hole. It is also possible that the nail or screw will be incorporated within the hole pointing downwardly towards the surface. It should be noted that even though the anchoring element 122, which is a hole in the ramp 12 is part of the dissecting barrier unit 10, according to some embodiments, the nail, screw, peg and the like are not necessarily part of the present subject matter and can be independently provided by a user of the dissecting barrier unit 10. According to a further embodiment, the anchoring of the ramp 12 to the surface is permanent. According to yet a further embodiment, the anchoring of the ramp 12 to the surface is temporary, or in other words—reversible.

According to one embodiment, the ramp 12 is configured to be connected to at least one other ramp 12. Any mechanism known in the art for connecting the ramp 12 to at least one other ramp 12 is under the scope of the present subject matter, for example tying, connecting, welding and the like. According to another embodiment, the connection of the ramp 12 to at least one other ramp 12 is permanent, for example by welding. According to yet another embodiment, the connection of the ramp 12 to at least one other ramp 12 is temporary, namely reversible. According to a further embodiment, the connection of the ramp 12 to at least one other ramp 12 is by using connectors, hooks and the like. According to an additional embodiment, the ramp 12 comprises at least one connecting element 124 configured to participate in the connection of the ramp 12 to at least one other ramp 12. Any type of connecting element is under the scope of the present subject matter. According to the exemplary embodiment, illustrated for example in FIG. 1, the connecting element 124 is a tube-like element attached preferably beneath the ramp 12 and configured to accommodate a shaft-like element (not seen) configured to be inserted into the tube-like element of one ramp 12 and a tube-like element of an adjacent ramp 12, thus connecting the ramps 12 and holding them together.

Figure 3:
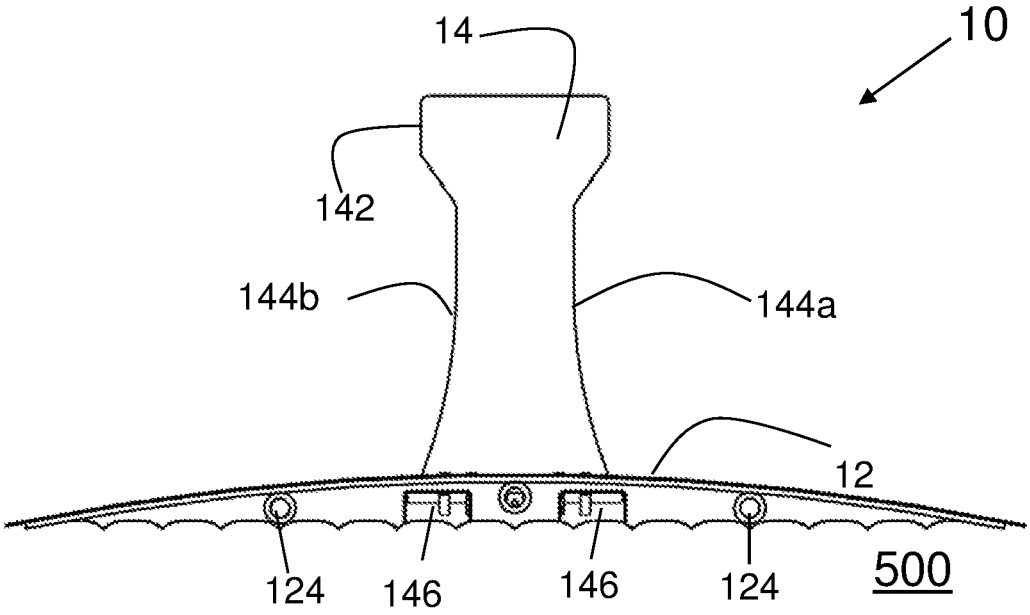
FIG. 3 schematically illustrates, according to an exemplary embodiment, a side view of a dissecting barrier unit in a vehicle blocking state.

Even if there is another mechanism to connect the ramps to each other, the tubes that are discussed herein before, which are used for the connection (connecting elements 124) of the ramps, are provided beneath the ramp 12 (especially in cases the ramp is curved, as will be discussed herein after) in order to strengthen the ramp onto which vehicles pass. This is clearly shown in FIG. 3 in which the connecting elements 124, which are preferably elongated tubes that are attached beneath the ramp through its entire length. In FIG. 3 one can see that the two opposite tubes 124 are between the ramp 12 and the surface 500.

According to one embodiment, the ramp 12 is configured to allow passage of a vehicle over the ramp 12. Thus, according to another embodiment, the ramp 12 is substantially flat, thus allowing passage of a vehicle over the ramp 12 while moving on the surface on which the ramp 12 is positioned. According to yet another embodiment, the ramp 12 is substantially curved as clearly seen in FIGS. 1 and 3. According to still another embodiment, the degree of curvature of the ramp 12 is such that it allows free passage of a vehicle over the ramp 12, for example like passing over a bump on a road, or less curved. It has been found by the inventor that a substantially curved shape confers strength to the ramp 12, comparted to a substantially flat shape.

According to one embodiment, the ramp 12 comprises at least one anchoring element 122 as described herein. According to another embodiment, the ramp 12 comprises at least one connecting element 124 as described herein. According to yet another embodiment, the ramp 12 comprises at least one anchoring element 122 and at least one connecting element 124, as described herein.

According to one embodiment, as described above, the dissecting barrier unit 10 comprises a ramp 12 and a dissecting element 14 connected to the ramp. The dissecting element 14 can be connected to any position on the ramp 12. According to this embodiment, the ramp 12 has any structure and dimensions known in the art, for example a rectangular shape as illustrated for example in FIG. 4.

According to another embodiment, the ramp 12 can have a minimal size, enough only to connect to the dissecting element 14 and allow anchoring of the dissecting barrier unit 10 to the surface as described herein, as well as optionally to be connected to another at least one dissecting barrier unit 10 as described herein.

According to an additional embodiment, the dissecting barrier unit 10 comprises a dissecting element 14. According to an additional embodiment, the dissecting element 14 is shaped and functions according to embodiments described herein. According to still an additional embodiment, the dissecting element 14 is configured to be anchored to a surface by mechanisms described herein in relation to the ramp 12.

According to one embodiment, the dissecting element 14 is configured to be in a vehicle blocking state as described herein. This embodiment relates to a dissecting barrier unit 10 comprising a dissecting element 14 and to a dissecting barrier unit 10 comprising a ramp 12 and a dissecting element 14 connected to the ramp 12.

According to another embodiment, the dissecting element 14 is configured to be in a vehicle blocking state, as illustrated in FIG. 1-5. In other words, the dissecting element 14 is at least partially erected relative to the surface on which the dissecting barrier unit 10 is positioned. Additional embodiments relating to the vehicle blocking state of the dissecting element 14 are described hereinafter.

According to one embodiment, the dissecting element 14 is pivotally connected to the ramp 12. According to another embodiment, the dissecting element 14 is configured to be in a vehicle blocking state, as illustrated in FIGS. 1-5. According to yet another embodiment, the dissecting element 14 is configured to be in a vehicle passage state, as illustrated in FIGS. 6-9.

In the vehicle blocking state, the dissecting element 14 is at least partially erected, while in the vehicle passage state the dissecting element 14 substantially rests on the surface 500 or on the ramp 12. Thus, in the vehicle blocking state, the dissecting element 14 is configured to block passage of a vehicle, while in the vehicle passage state the dissecting element 14 is configured to allow passage of a vehicle over the dissecting element 14 without being harmed.

Figure 4:
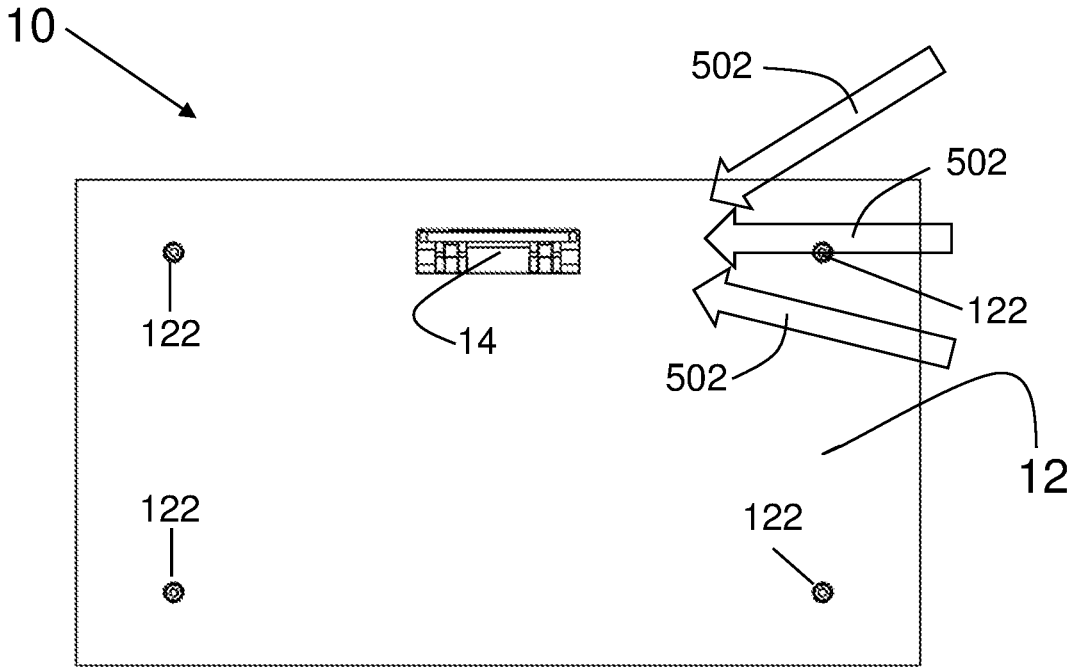
FIG. 4 schematically illustrates, according to an exemplary embodiment, a top view of a dissecting barrier unit in a vehicle blocking state.

According to one embodiment, the dissecting element 14 comprises a substantially flat body having two wide edges 142 at the upper side of the dissecting element and two narrow edges 144 at the bottom, while the narrow edges are longer than the wide edges. According to another embodiment, in the vehicle blocking state, the dissecting element 14 is positioned with the edges 142 and 144 facing a potential moving vehicle. In FIG. 4, illustrating a top view of the dissecting barrier unit 10 in a vehicle blocking position, arrows 502 indicate possible directions of movement of a vehicle in relation to the orientation of the dissecting element 14 in which the action of the barrier is most effective. It can be seen in FIG. 4 that the edges of the dissecting element 14 face the directions indicated by arrows 502 of a vehicle. Thus, when a vehicle moves straight toward the erected dissecting element 14 in the vehicle blocking state, in direction 502, at least one of the wide and narrow edges 142 and 144 of the dissecting element 14 is configured to impact the vehicle and block its movement. In addition, the dissecting element 14 is configured to potentially dissect portions of the vehicle because at least one of the edges, the narrow edges 144 and the wide edges 142 is the part of the dissecting element 14 that impacts the vehicle that moves towards the barrier in relatively high speed. In other words, according to one embodiment, at least one of the narrow edges 144 of the dissecting element 14 is configured to dissect a vehicle when the dissecting element 14 impacts the vehicle.

FIG. 4 further illustrates by arrows 502 possibilities of the direction of movement of a vehicle toward the dissecting element 14. Even when the direction of movement of the vehicle is not straight toward the dissecting element 14 (as the direction of the arrow in the middle), but rather angular, the dissecting element 14 is still configured to block the movement of the vehicle, and potentially dissect at least some portions of the vehicle.

According to one embodiment, at least one of the edges 142 and 144 of the dissecting element 14 and at least one of the opposite edges is sharp, having a blade-like shape. As an example shown in FIG. 3, a first narrow edge 144*a* is sharp having a blade-like shape; or a second narrow edge 144*b* is sharp having a blade-like shape; or both the first narrow edge 144*a* and the second narrow edge 144*b* are sharp and are having a blade-like shape.

Figure 5:
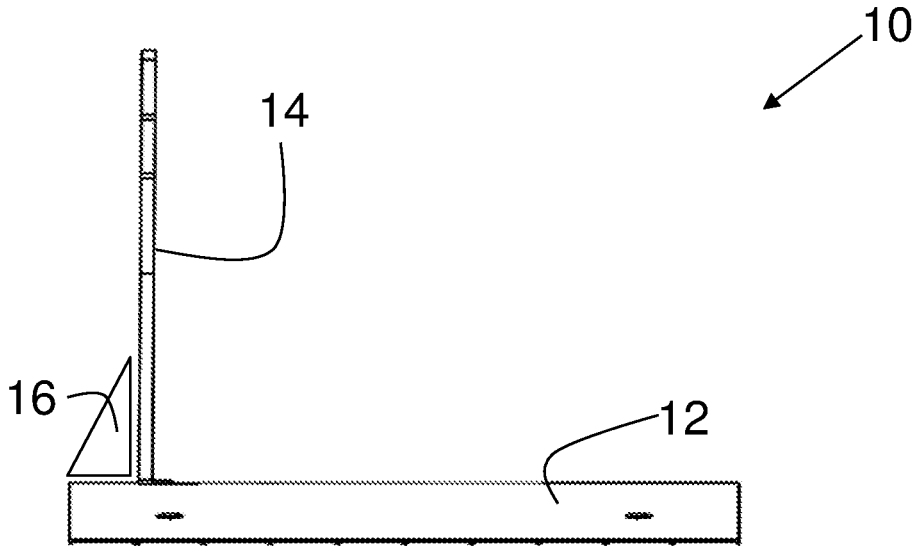
FIG. 5 schematically illustrates, according to an exemplary embodiment, a front view of a dissecting barrier unit in a vehicle blocking state, further comprising a stopper.
Figure 6:
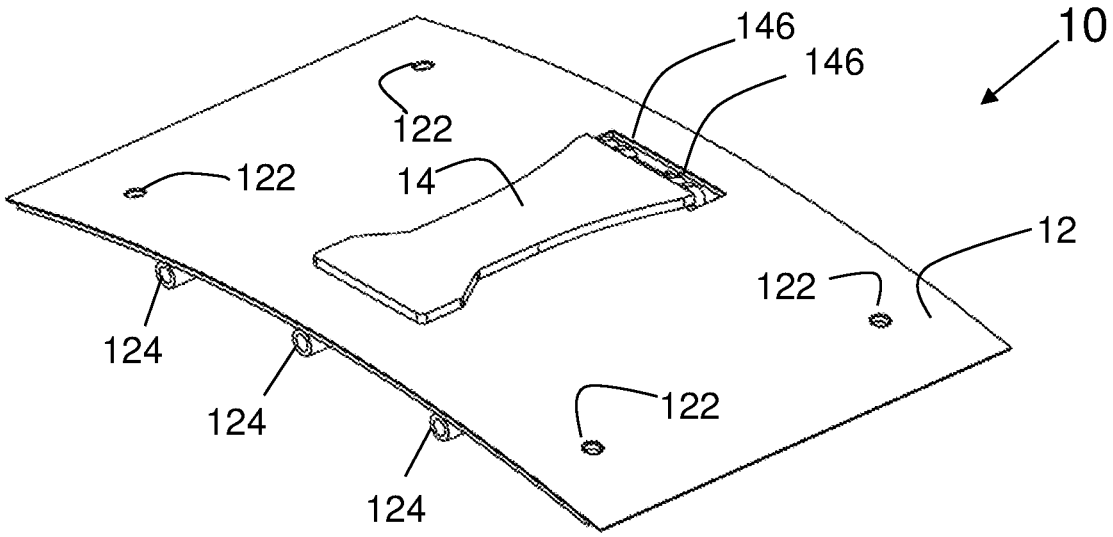
FIG. 6 schematically illustrates, according to an exemplary embodiment, a side perspective view of a dissecting barrier unit in a vehicle passage state.
Figure 7:
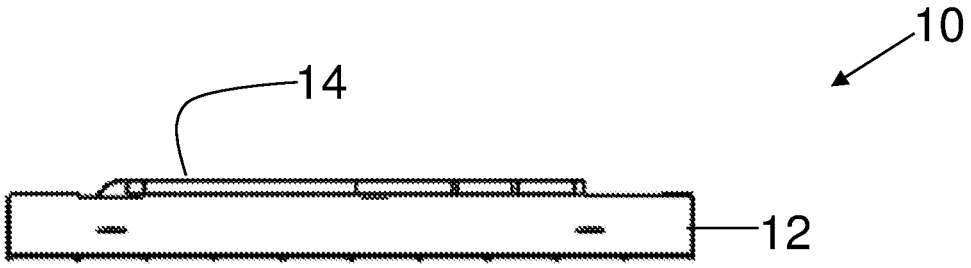
FIG. 7 schematically illustrates, according to an exemplary embodiment, a front view of a dissecting barrier unit in a vehicle passage state.
Figure 8:
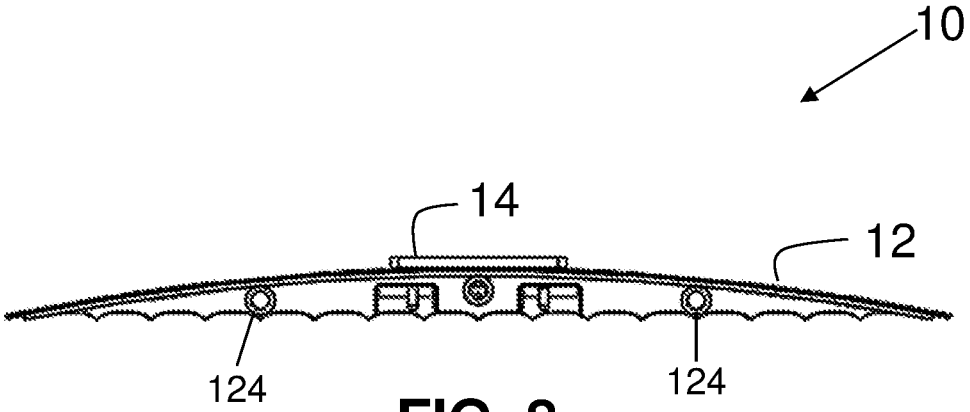
FIG. 8 schematically illustrates, according to an exemplary embodiment, a side view of a dissecting barrier unit in a vehicle passage state.
Figure 9:
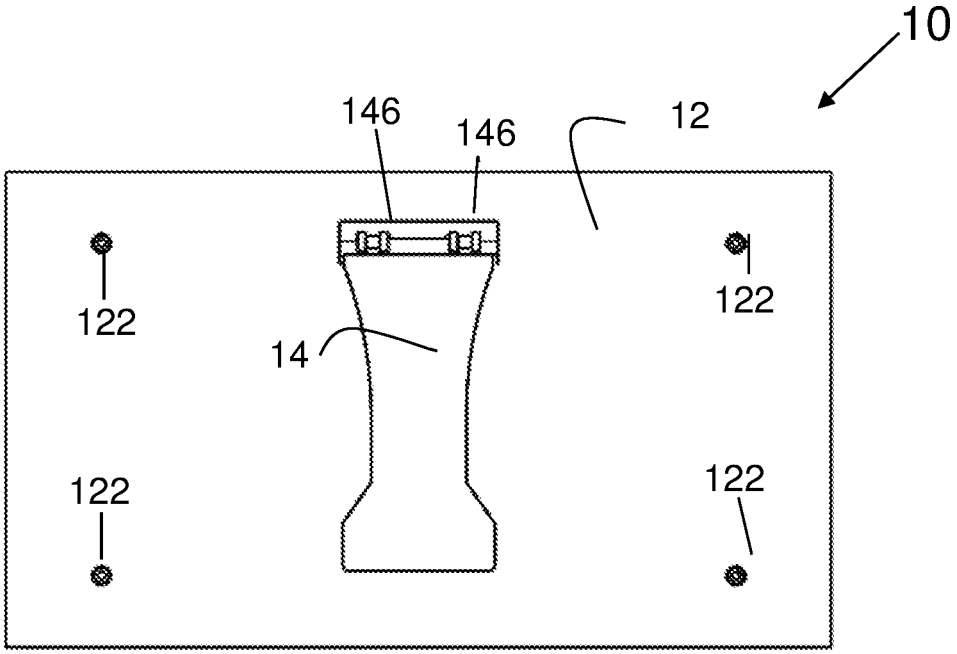
FIG. 9 schematically illustrates, according to an exemplary embodiment, a top view of a dissecting barrier unit in a vehicle passage state.

As mentioned above, in the vehicle blocking state, the dissecting element 14 is configured to erect substantially perpendicularly to the surface on which the dissecting barrier unit 10 is placed. This may be achieved, for example, by the shape of the hinge 146 with which the dissecting element 14 is pivotally connected to the ramp 12. Alternatively or additionally, according to one embodiment, the dissecting barrier unit 10 comprises a stopper 16 configured to stop movement of the dissecting element 14 and hold the dissecting element 14 in a substantially perpendicular and firm erected position. The stopper 16 is illustrated in FIG. 5.

As mentioned herein before, FIGS. 6-9 schematically illustrates, according to an exemplary embodiment, different views of a dissecting barrier unit in a vehicle passage state. The structure of the dissecting element is shown in a non-erected state in which the dissecting element 14 is adjacently lying on the ramp 12.

Figure 10:
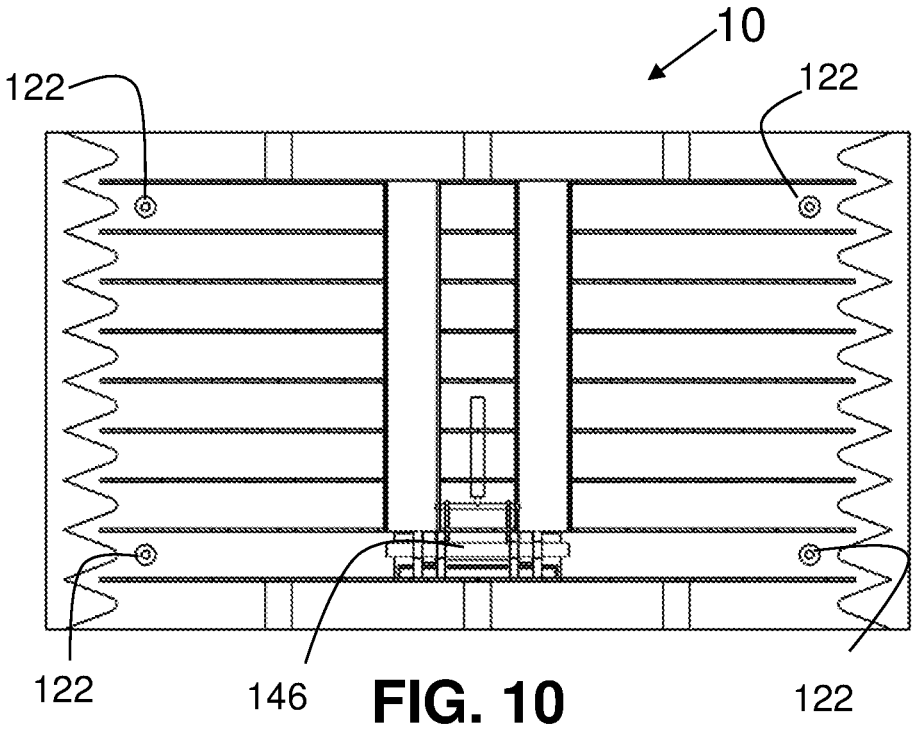
FIG. 10 schematically illustrates, according to an exemplary embodiment, a bottom view of a dissecting barrier unit.

Reference is now made to FIG. 10 schematically illustrating, according to an exemplary embodiment, a bottom view of a dissecting barrier unit. The holes of the anchoring elements 122 are shown to indicate that the holes pass through the ramp 12. The bottom portion of the hinge 146 that allows the erection of the dissection element 14 is shown where the base of the dissecting element (not shown in the figure) is positioned.

Figure 11:
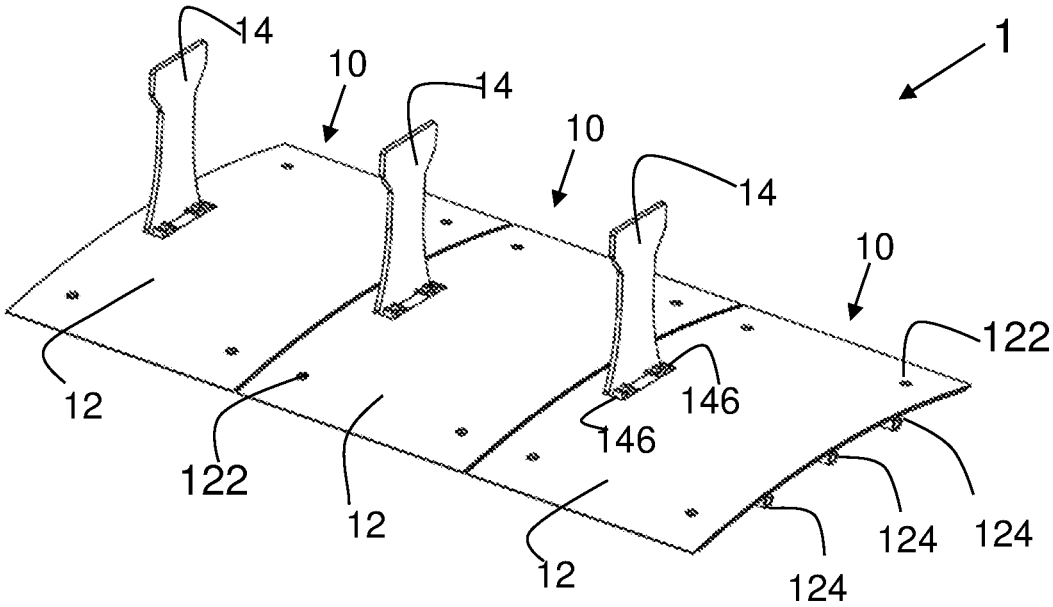
FIG. 11 schematically illustrates, according to an exemplary embodiment, a side perspective view of a dissecting barrier system in a vehicle blocking state.
Figure 12:
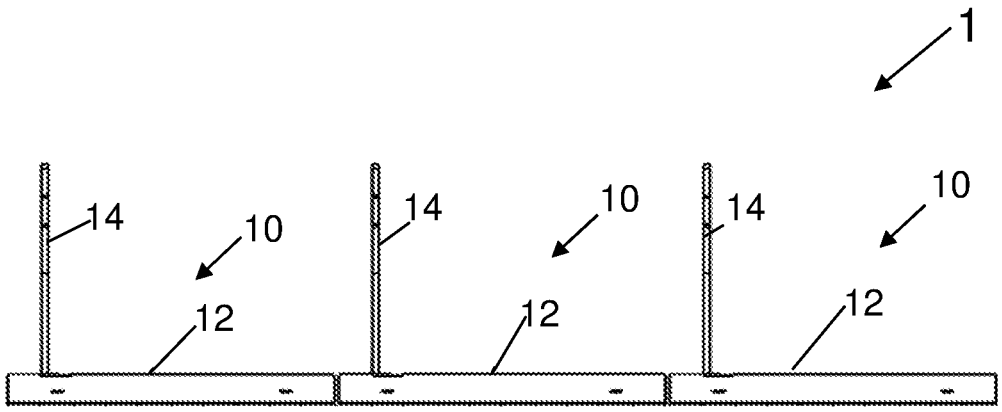
FIG. 12 schematically illustrates, according to an exemplary embodiment, a front view of a dissecting barrier system in a vehicle blocking state.
Figure 13:
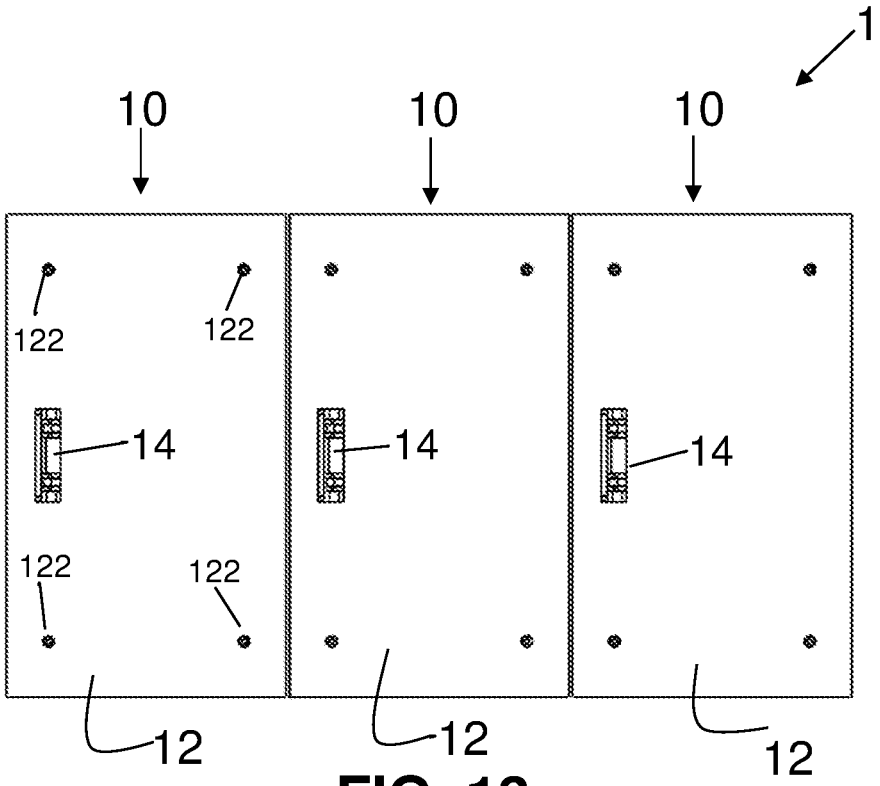
FIG. 13 schematically illustrates, according to an exemplary embodiment, a top view of a dissecting barrier system in a vehicle blocking state.

The present subject matter further provides a dissecting barrier system. Reference is now made to FIGS. 11-13 schematically illustrating, according to an exemplary embodiment, different views of a dissecting barrier system in a vehicle blocking state. According to one embodiment, a dissecting barrier system 1 comprises a plurality of dissecting barrier units 10. Furthermore, in an embodiment in which the dissecting barrier system 1 comprises a plurality of dissecting barrier units 10, at least some of the dissecting barrier units 10 are connected one to the other. According to another embodiment, all the dissecting barrier units 10 of the dissecting barrier system 1 are connected one to the other. According to yet another embodiment, the dissecting barrier units 10 of the dissecting barrier system 1 are not connected one to the other but are positioned one aside the other.

It should be noted that the dissecting barrier system can also provide a plurality of dissecting elements that are directly connected to the surface—the ground.

All the embodiments in relation to the dissecting barrier unit 10 pertain also to the dissecting barrier units 10 of the dissecting barrier system 1.

Figure 14:
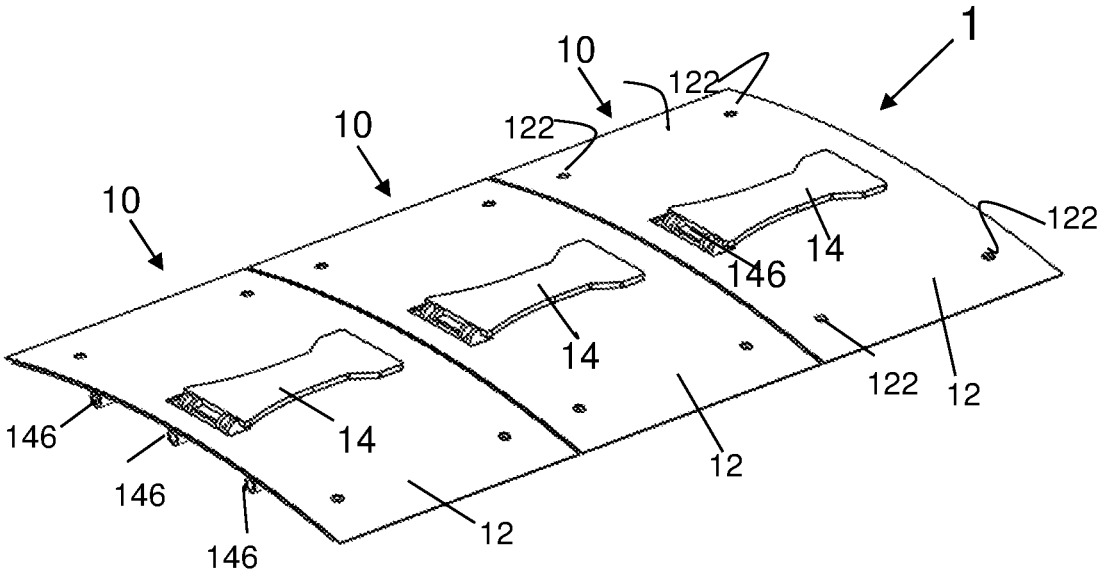
FIG. 14 schematically illustrates, according to an exemplary embodiment, a front perspective view of a dissecting barrier system in a vehicle passage state.
Figure 15:
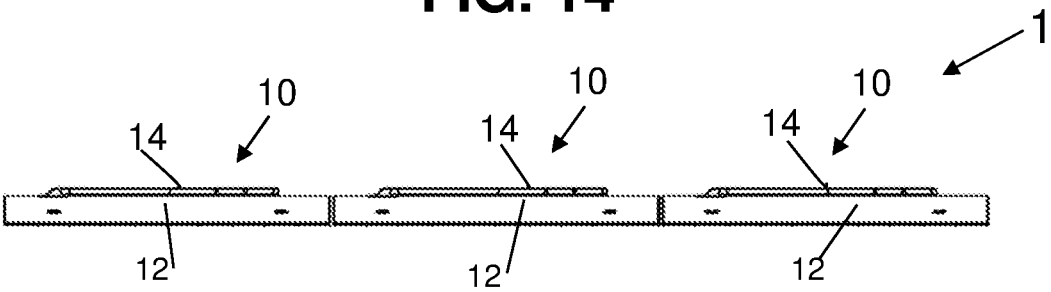
FIG. 15 schematically illustrates, according to an exemplary embodiment, a side view of a dissecting barrier system in a vehicle passage state.
Figure 16:
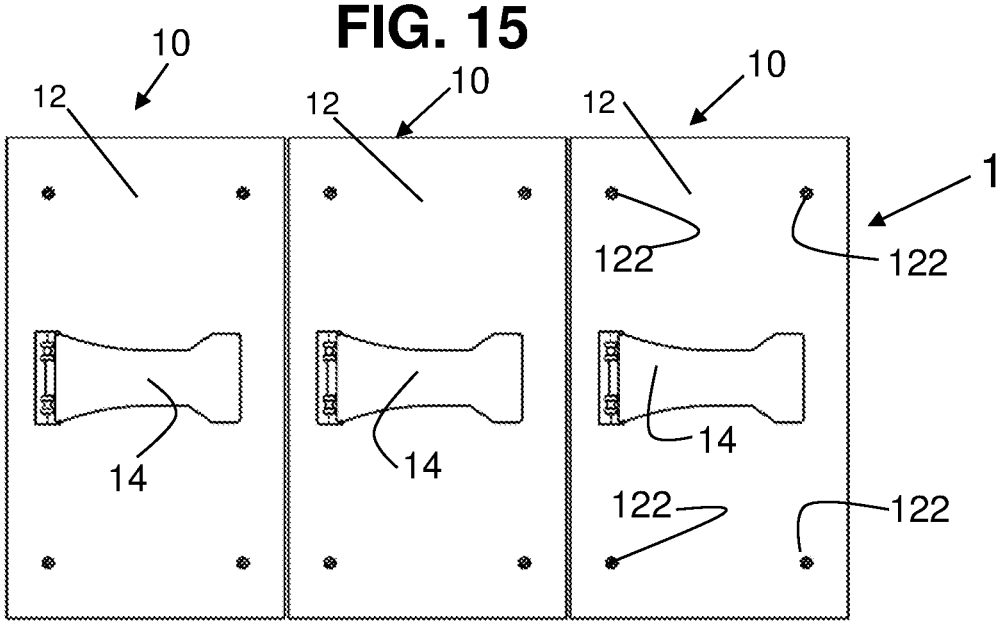
FIG. 16 schematically illustrates, according to an exemplary embodiment, a top view of a dissecting barrier system in a vehicle passage state.

Reference is now made to FIG. 14-16 schematically illustrating, according to an exemplary embodiment, a front perspective view of a dissecting barrier system in a vehicle passage state. According to this embodiment, all the dissecting units 10 of the dissecting barrier system 1 are in a vehicle passage state. According to yet another embodiment, some of the dissecting barrier units of the dissecting barrier system are in a vehicle blocking state, and some dissecting barrier units are in a vehicle passage state. In other words, according to an additional embodiment, the dissecting barrier units of the dissecting barrier system 1 are independent one in relation to the other in terms of their state—vehicle blocking state and vehicle passage state. According to yet an additional embodiment, the dissecting barrier units 10 of the dissecting barrier system 1 depend one on the other in terms of their state—vehicle blocking state and vehicle passage state. In other words, the dissecting barrier system comprises, according to a further embodiment, a mechanism that controls the state of at least some of the dissecting barrier units 10, for example by connecting wires that are connected to the dissecting element 14 of the dissecting barrier system 1 and allow simultaneous shifting of the dissecting elements 14 between the vehicle blocking state and the vehicle passage stage.

Figure 17:
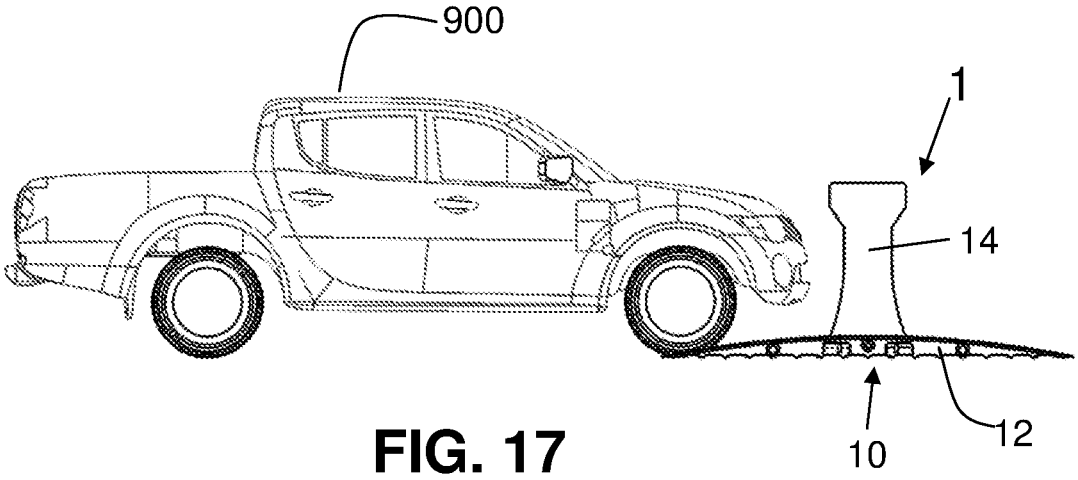
FIG. 17 schematically illustrates, according to an exemplary embodiment, a side view of a vehicle approaching a dissecting barrier system in a vehicle blocking state.
Figure 18:
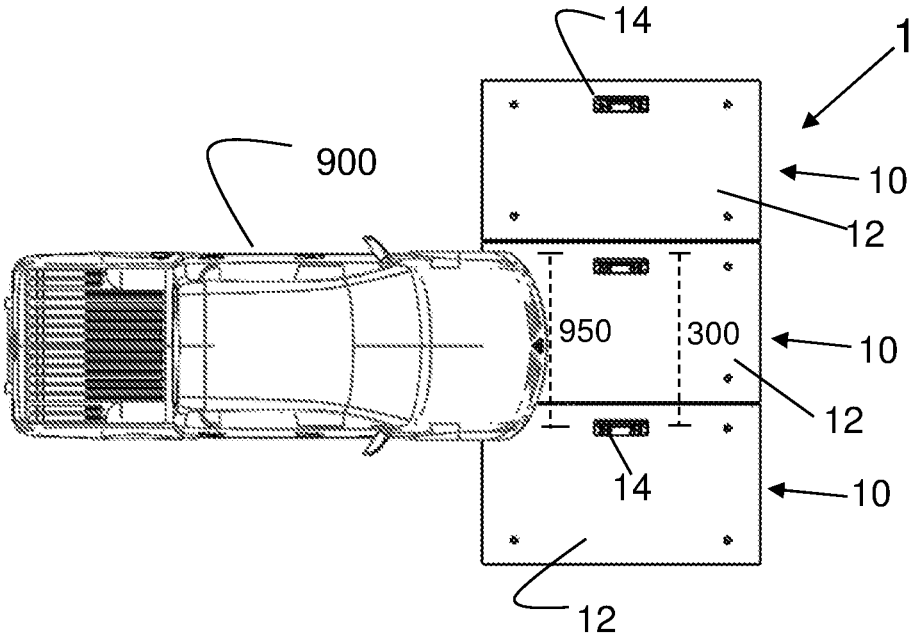
FIG. 18 schematically illustrates, according to an exemplary embodiment, a top view of a vehicle approaching a dissecting barrier system in a vehicle blocking state.
Figure 19:
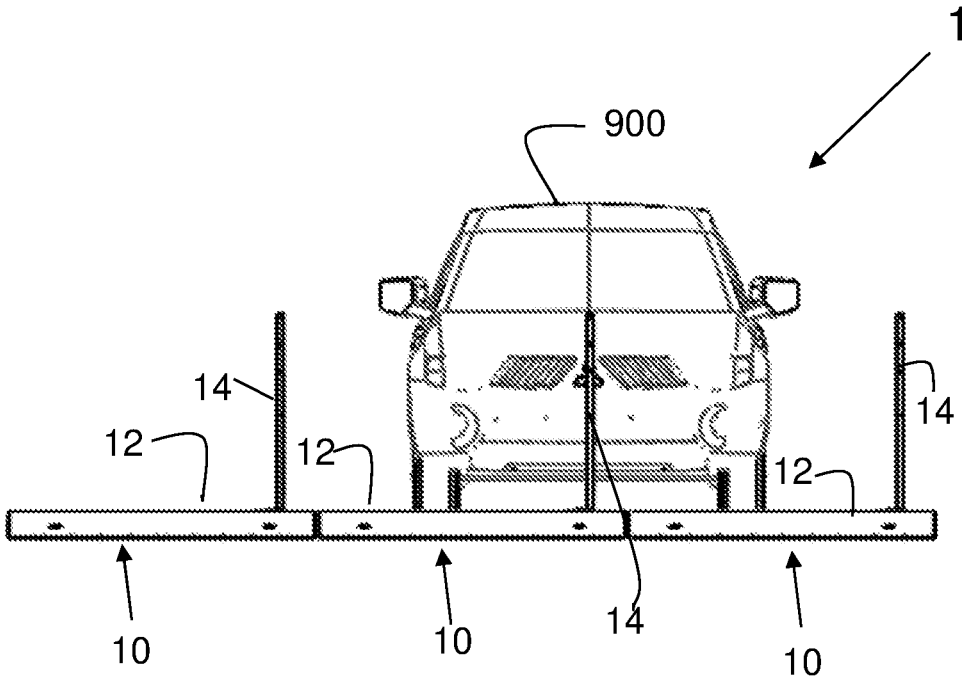
FIG. 19 schematically illustrates, according to an exemplary embodiment, a front view of a vehicle approaching a dissecting barrier system in a vehicle blocking state.

As discussed herein before regarding the dissecting unit, the placement of the barrier for blocking vehicles is dependent on the direction of the vehicles. Reference is now made to FIG. 17 schematically illustrating, according to an exemplary embodiment, a side view of a vehicle approaching a dissecting barrier system in a vehicle blocking state. The barrier 1 is placed with one of the edges of the dissecting element 14 towards the direction of the coming vehicles. Vehicle 900 is shown to approach the barrier 1 in a position that is most effective as to the blockage of the vehicle. FIGS. 18 and 19 illustrates similar positioning of the vehicle versus the barrier, in different views.

As illustrated in FIG. 18, a length of a gap between two adjacent dissecting elements 14, in a vehicle blocking position, which are part of a dissecting barrier system 1, is defined as gap that is indicated by line 300. In addition, a vehicle 900 approaching the dissecting barrier system 1 has a width indicated by line 950. According to one embodiment, the gap 300 between two adjacent dissecting elements 14 in a vehicle blocking position, is smaller than the width 950 of the vehicle 900 (or any other typical vehicle) approaching the dissecting barrier system 1. Therefore, the dissecting barrier system 1 is configured to block passage of vehicles 900, because a vehicle 900 is not capable of passing through the gap 300 between two adjacent dissecting elements 14 in a barrier blocking state. Nevertheless, the gap 300 between two adjacent dissecting elements 14 in a barrier blocking state allows free passage of pedestrians, animals and small vehicles like bicycles and motorcycles (not shown). It should be noted that even if the width of the vehicle is just a little smaller than the gap between the dissecting elements, it is most likely that an attempt to pass through two adjacent dissecting elements will receipt in at least dissection of the vehicle's wheels.

Therefore, a method of blocking vehicles is provided in accordance with another embodiment of the present subject matter, while the method comprising: providing a dissecting element or a dissecting barrier unit as shown herein although the description, and positioning the dissecting element with the opposite edges directed towards a direction from which the vehicles are approaching.

Figure 20:
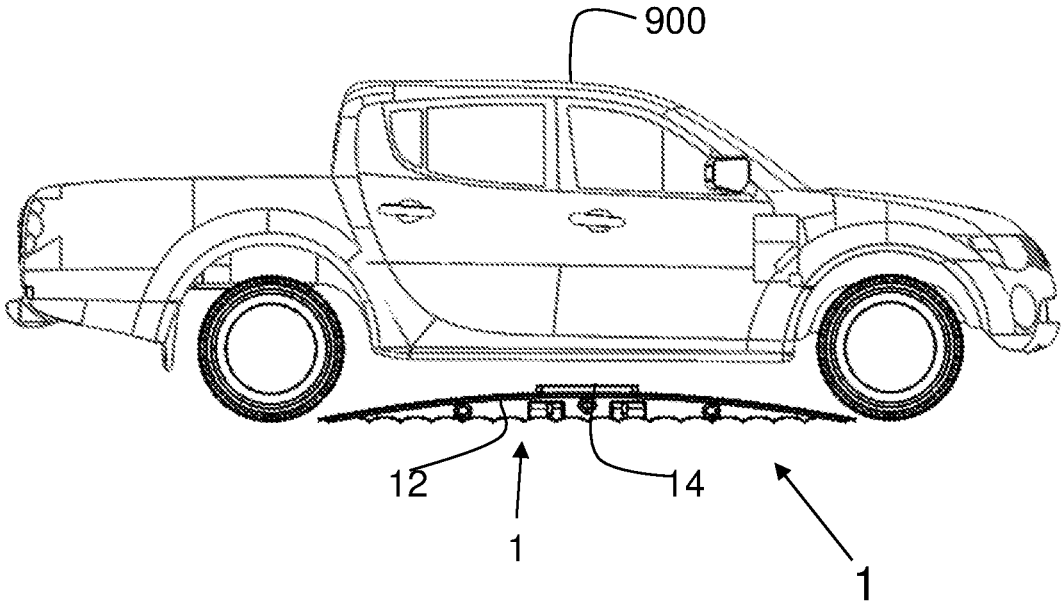
FIG. 20 schematically illustrates, according to an exemplary embodiment, a side view of a vehicle passing over a dissecting barrier system in a vehicle passage state.
Figure 21:
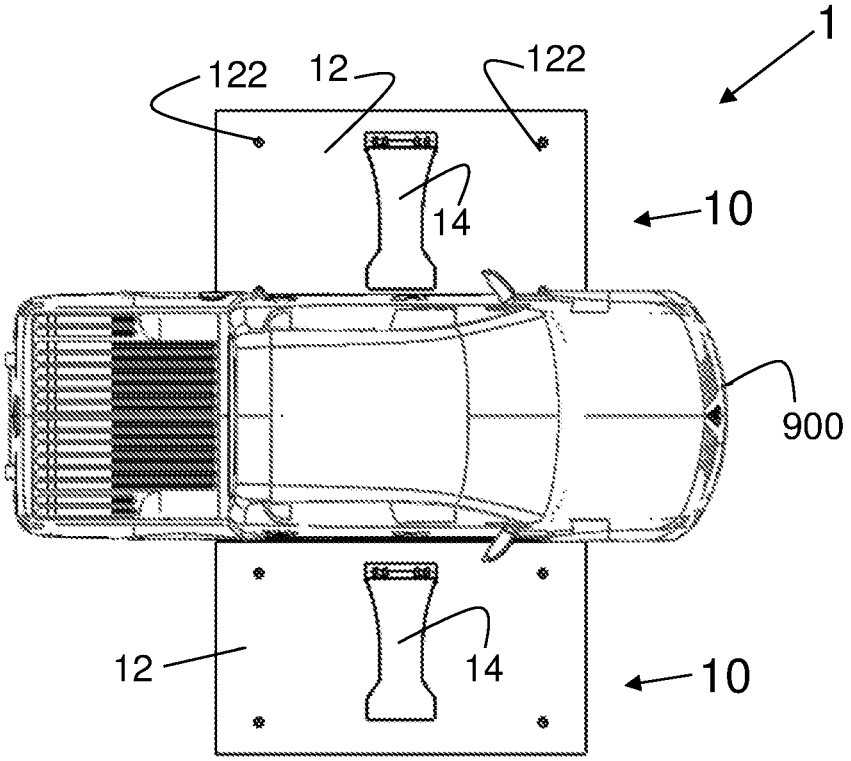
FIG. 21 schematically illustrates, according to an exemplary embodiment, a top view of a vehicle passing over a dissecting barrier system in a vehicle passage state.

Reference is now made to FIGS. 20 and 21 schematically illustrating, according to an exemplary embodiment, a side view and a top view, respectively, of a vehicle passing over a dissecting barrier system in a vehicle passage state. According to one embodiment, when the dissecting elements 14 of a dissecting barrier unit 1 are in the vehicle passage state, passage of vehicle 900 over the dissecting barrier system 1 is allowed and possible without harming the vehicle. Needless to say that passage of pedestrians, animals and small vehicles like bicycles and motorcycles is also allowed when the dissecting elements 14 of the dissecting barrier unit 1 are in a vehicle passage state as in the blocking state.

It should be noticed that the changes of the states—passing vehicles or blockage of vehicles—is controlled automatically or manually by changing the state of the hinges between the dissecting elements and the ramps. The movement of the dissecting elements from an upright position or erected position to lying position can be controlled electronically, manually, hydraulically, pneumatically etc. In any case in which the barrier is automatically controlled, it can be operated from a distance by a remote control.

The subject matter describes a method to prevent passage of vehicles. The method of blocking vehicles comprises providing a plurality of dissecting element or a dissecting barrier units and positioning the dissecting element or the units with the opposite edges of the dissecting elements so as to be directed towards a direction from which the vehicles are approaching.

It is appreciated that certain features of the subject matter, which are, for clarity, described in the context of separate embodiments, may also be provided in combination in a single embodiment. Conversely, various features of the subject matter, which are, for brevity, described in the context of a single embodiment, may also be provided separately or in any suitable sub combination.

Although the subject matter has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A dissecting barrier unit for blocking a fast-approaching vehicle comprising:

at least one dissecting element sized to reach at least the height of a chassis of the vehicle having a flat body with opposite side edges, wherein at least one edge of the opposite side edges is a sharp edge that is arranged to substantially face a potential direction of the vehicle; and a ramp onto which said at least one dissecting unit is pivotally connected, wherein the at least one dissecting element is configured to move between an erected active state in which the flat body is in an upright position capable of dissecting parts of the fast-approaching vehicle in front of wheels of the vehicle that first encounter the sharp edge and a horizontal inactive state in which the flat body is adjacently lying on the ramp allowing the vehicle to pass through, and wherein the dissecting element is configured to block the fast-approaching vehicle by dissecting the chassis, motor, and tires of the vehicle when the vehicle impacts the dissecting element.

2. The dissecting barrier unit of claim 1, wherein the at least one dissecting element is pivotally connected to the ramp by a hinge.

3. The dissecting barrier unit of claim 1, wherein the ramp is configured to permanently or reversibly be connected to the at least one other ramp.

4. The dissecting barrier unit of claim 1, wherein the ramp is configured to allow passage of a vehicle over the ramp when the dissecting elements are in a horizontal state.

5. The dissecting barrier unit of claim 1, wherein the ramp is substantially flat or curved.

6. The dissecting barrier unit of claim 1, wherein the flat body has an upper side that is wide and lower side that is relatively narrow.

7. The dissecting barrier unit of claim 1, wherein at least part of the edges of the dissecting element is sharp, having a blade-like shape.

8. The dissecting barrier unit of claim 1, wherein the dissecting element further comprises a stopper configured to stop movement of the dissecting element and firmly hold the dissecting element in the erected state.

9. The dissecting barrier unit of claim 1, wherein the ramp is configured to be anchored to a surface.

10. The dissecting barrier unit of claim 9, wherein the ramp is permanently anchored to the surface.

11. The dissecting barrier unit of claim 9, wherein the ramp is reversibly anchored to the surface.

12. The dissecting barrier unit of claim 1, wherein the ramp further comprises at least one connecting element for connecting the ramp to the at least one other ramp.

13. The dissecting barrier unit of claim 12, wherein the connecting element is a tube-like element attached beneath the ramp and configured to accommodate a shaft-like element configured to be inserted into the tube-like element of one ramp and a tube-like element of an adjacent ramp, thus connecting the ramps and holding them together.

14. The dissecting barrier unit of claim 5, wherein a degree of curvature of the ramp is such that it allows free passage of a vehicle over the ramp when the dissecting elements are in a horizontal state.

15. A dissecting barrier system comprising a plurality of dissecting barrier units according to claim 1.

16. The dissecting barrier system of claim 15, wherein at least two of the dissecting barrier units are connected one to the other.

17. The dissecting barrier system of claim 15, wherein each one of the dissecting barrier units is independently controlled.

18. The dissecting barrier system of claim 15, wherein each one of the dissecting barrier units is adapted to be in an erected state or in horizontal state.

19. The dissecting barrier system of claim 15, wherein each one of the dissecting barrier units is independently controlled.

20. The dissecting barrier system of claim 19, wherein the dissecting barrier units are remotely controlled.

21. The dissecting barrier system of claim 17, wherein the dissecting elements are remotely controlled.

* * * * *